US006715965B2

(12) United States Patent
Manthei et al.

(10) Patent No.: US 6,715,965 B2
(45) Date of Patent: Apr. 6, 2004

(54) RETAINING WALL BLOCKS AND RETAINING WALLS CONSTRUCTED FROM SUCH BLOCKS

(75) Inventors: Benjamin R. Manthei, Petoskey, MI (US); James A. Manthei, Petoskey, MI (US)

(73) Assignee: Redi-Rock International, LLC, Charlevoix, MI (US)

( * ) Notice: Subject to any disclaimer, the term of this patent is extended or adjusted under 35 U.S.C. 154(b) by 0 days.

(21) Appl. No.: 09/832,388

(22) Filed: Apr. 11, 2001

(65) Prior Publication Data

US 2001/0019684 A1 Sep. 6, 2001

Related U.S. Application Data

(63) Continuation-in-part of application No. 09/670,924, filed on Sep. 28, 2000.

(60) Provisional application No. 60/232,526, filed on Sep. 14, 2000, and provisional application No. 60/156,889, filed on Sep. 30, 1999.

(51) Int. Cl.[7] ..... E02D 29/02; E04B 2/32

(52) U.S. Cl. ..... 405/284; 405/262; 405/286; 52/169.2; 52/592.6

(58) Field of Search ..... 405/15, 16, 21, 405/23, 25, 31, 33, 110, 114, 262, 284–286; 52/169.1, 169.2, 283, 284, 286, 592.6, 603–607

(56) References Cited

U.S. PATENT DOCUMENTS

| | | | | | |
|---|---|---|---|---|---|
| 2,826,906 | A | * | 3/1958 | RIce | 52/606 X |
| 4,524,551 | A | * | 6/1985 | Scheiwiller | 405/286 X |
| 4,671,706 | A | * | 6/1987 | Giardini | 405/286 |
| 4,964,761 | A | * | 10/1990 | Rossi | 405/286 |
| 5,163,261 | A | * | 11/1992 | O'Neill | 52/602 X |
| 5,230,195 | A | | 7/1993 | Sease | 52/593 |
| 5,337,527 | A | * | 8/1994 | Wagenaar | 52/169.2 |
| 5,402,609 | A | | 4/1995 | Kelley, Jr. | 52/98 |
| 5,601,384 | A | * | 2/1997 | Dawson | 405/284 |
| 5,647,185 | A | | 7/1997 | Forlini | 52/604 |
| 5,651,642 | A | * | 7/1997 | Kelley, Jr. et al. | 405/286 |
| 5,678,958 | A | * | 10/1997 | Rossi | 405/286 |
| 5,791,827 | A | | 8/1998 | Arvai et al. | 405/286 |
| 5,934,037 | A | * | 8/1999 | Bundra | 52/603 |
| 6,019,550 | A | * | 2/2000 | Wrigley et al. | 405/262 |
| 6,024,517 | A | * | 2/2000 | Castonguay et al. | 405/286 |
| 6,082,933 | A | * | 7/2000 | Maguire et al. | 405/286 |
| D435,917 | S | * | 1/2001 | Hammer | D25/113 |
| 6,250,850 | B1 | * | 6/2001 | Price et al. | 405/284 |
| 6,287,054 | B1 | * | 9/2001 | Egan et al. | 405/262 |

FOREIGN PATENT DOCUMENTS

| | | | | |
|---|---|---|---|---|
| EP | 0039372 | * | 11/1981 | 405/16 |
| GB | 2182374 | * | 5/1987 | 405/286 |

* cited by examiner

*Primary Examiner*—Jong-Suk (James) Lee
(74) *Attorney, Agent, or Firm*—MacMillan, Sobanski & Todd, LLC

(57) ABSTRACT

Retaining walls are formed from one or more tiers of concrete blocks. Top projections on all except the uppermost tier of blocks are received in recesses in the bottom of blocks in an adjacent upper tier. The top of the retaining wall may be finished with blocks which have a surface portion recessed below an upper edge of the face of the block for extending top soil or other material up to the block face. Alternately, the top blocks may form a drainage ditch which extends along at least a portion of the top of the retaining wall. Blocks used in tiers below the uppermost tier may have troughs suitable for filling with soil and plants. The exposed faces of the blocks are textured and, optionally, may be colored to simulate the appearance of stone or rocks.

9 Claims, 8 Drawing Sheets

RETAINING WALL BLOCKS AND RETAINING WALLS CONSTRUCTED FROM SUCH BLOCKS

CROSS-REFERENCE TO RELATED APPLICATIONS

Applicants claim priority to U.S. provisional patent application Ser. No. 60/232,526 filed Sep. 14, 2000. This application also is a continuation-in-part of U.S. patent application Ser. No. 09/670,924 filed Sep. 28, 2000, which in turn claims priority to U.S. provisional patent application Ser. No. 60/156,889 filed Sep. 30, 1999.

STATEMENT REGARDING FEDERALLY SPONSORED RESEARCH OR DEVELOPMENT

Not Applicable.

TECHNICAL FIELD

The invention relates to concrete retaining wall blocks and to retaining walls constructed from such blocks.

BACKGROUND OF THE INVENTION

Concrete blocks are frequently used for constructing retaining walls. Rectangular blocks have been stacked to form a retaining wall and then back filled on one side to form a terrace. The backfill can exert a sufficient force on the retaining wall blocks to cause the stacked blocks to move out of their original position. In some cases, the blocks are stacked to form a stepped wall so that the front face of each row or tier of blocks is offset slightly behind the front face of the adjacent lower row of blocks. Further, a raised lip has sometimes been formed along the upper edge of the block adjacent the front face to prevent the stepped blocks from sliding out of position, as shown in Arvai et al. U.S. Pat. No. 5,791,827. In order to eliminate this problem, retaining wall blocks have sometimes been formed with a groove extending along a bottom surface parallel to an exposed face of the block and a raised portion is formed on a top surface to extend parallel to the front face. The groove on a stacked block receives the raised portion on an adjacent lower block for maintaining alignment of the front faces of the stacked blocks. Such an arrangement is shown, for example, in Forlini U.S. Pat. No. 5,647,185. Retaining wall blocks also may be formed with round knobs on the top surface which fit into a groove on the bottom surface of a stacked block to permit forming a curved retaining wall, as shown in Wagenaar U.S. Pat. No. 5,337,527. Another method for stabilizing a retaining wall constructed from concrete blocks is through the use of a geogrid tie back system in which the retaining wall is secured to the ground behind the retaining wall with ground anchors. The use of ground anchors for stabilizing retaining walls is shown, for example, in Kelly, Jr. U.S. Pat. No. 5,402,609 and in Wagenaar U.S. Pat. No. 5,337,517.

BRIEF SUMMARY OF THE INVENTION

The invention is directed to retaining wall blocks and to retaining walls formed from such blocks. The retaining wall is constructed from tiers of cast concrete blocks which are trapezoidal in plan and have rectangular front faces which are textured and, optionally, colored to simulate a desired type of stone or rock. The blocks are provided with at least one top projection or knob which is received by a bottom groove in a block in an adjacent upper tier for interlocking the tiers of blocks. Preferably, the bottom groove is omitted from the blocks in the lowermost tier.

The top projections are omitted from blocks used in the top row of blocks in the retaining wall. The top blocks may have an top surface portion which is recessed below an upper edge of the front face of the blocks to allow extending top soil or other material over the top surface portion up to the front face. In an alternate embodiment, the upper surface of the top blocks is recessed below upper edges of the front and rear to define a trough extending between the sides parallel to the front face. The troughs in a row of top blocks form a drain ditch which extends along the top of the retaining wall.

Planter blocks also may be used in one or more tiers below the uppermost tier. Each planter block has a trough in its upper surface which extends between the sides of the block parallel to and adjacent the front face of the block. The knobs on the top of the planter block are spaced further behind the front face than the bottom recess, so that the front face of blocks in an adjacent upper tier are spaced behind the front face of the planter block and at least a portion of the trough is exposed. The trough may be filled with soil and plants.

In a further embodiment, the blocks are provided with finished front and rear faces for constructing a free standing wall.

Accordingly, it is an object of the invention to provide retaining wall blocks and retaining walls constructed from such blocks.

Other objects and advantages of the invention will become apparent from the following detailed description of the invention and the accompanying drawings.

DETAILED DESCRIPTION OF THE INVENTION

Figure 1:
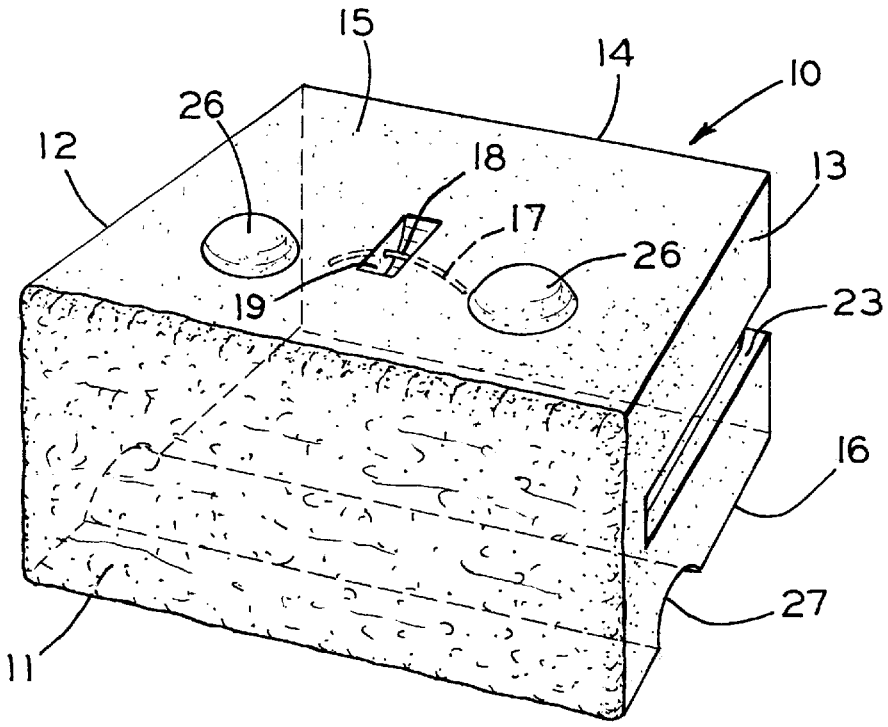
FIG. 1 is a perspective view as seen from the upper right front of a basic retaining wall block for constructing a retaining wall according to the invention.
Figure 2:
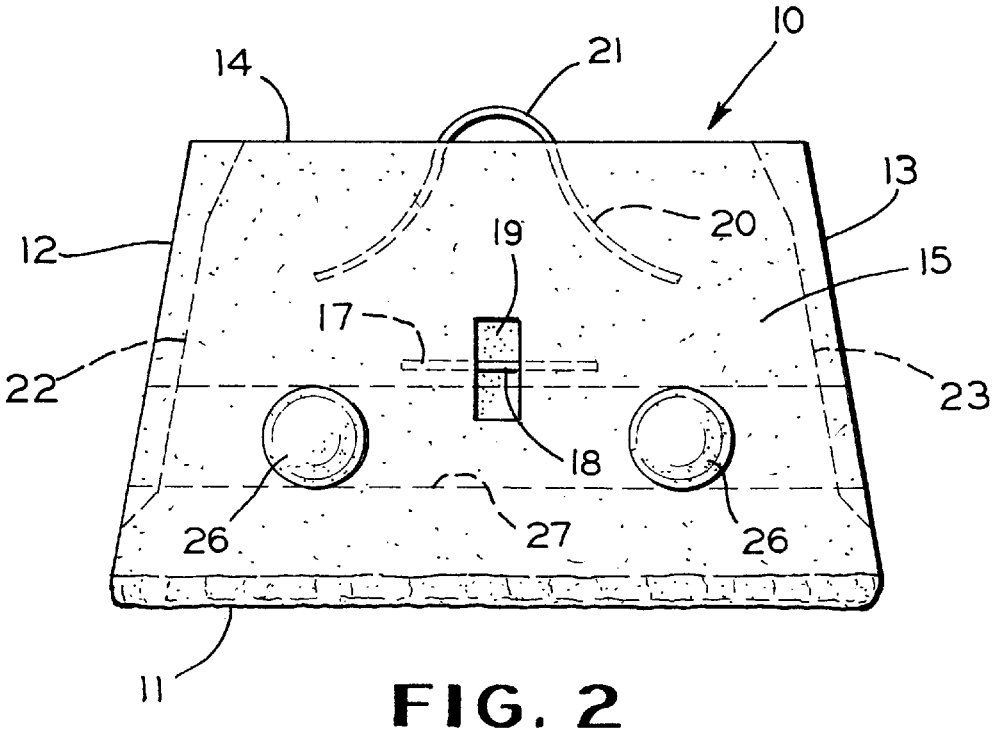
FIG. 2 is a top plan view of the retaining wall block of FIG. 1.

The invention is directed to concrete blocks for manufacturing retaining walls of various configurations and to retaining walls manufactured from such blocks. FIGS. 1 and 2 illustrate a basic block 10 for use in constructing a retaining wall according to the invention. The block 10 is suitable for use in tiers of a retaining wall other than the uppermost or top tier. The block 10 has a rectangular front face 11 which is textured and, optionally, may be colored to represent various types of stone and rock. The block 10 has left and right sides 12 and 13, a rear 14, a top 15 and a bottom 16. Preferably, the block 10 is trapezoidal in plan with the front face 11 and the rear 14 substantially parallel. By making the length of the rear 14 shorter than the length of the front face 11 and by angling at least one of the sides 12 and 13 slightly towards the center of the rear 14 of the block 10, a curved retaining wall may be constructed with the front faces 11 of adjoining blocks 10 abutting.

Optionally, a wire or rod 17 may be embedded in the block 10 to have a portion 18 which extends across a recess 19 formed in the top 15. The rod portion 18 is adapted to be engaged with a block lifting mechanism, such as a chain connected to a fork lift or a backhoe. The rod portion 18 facilitates lifting the block 10 with the top 15 and bottom 16 substantially horizontal for transporting the block 10 and for constructing a retaining wall. Preferably, a rod 20 also is embedded in the block 10 to form a loop 21 which extends beyond the rear 14. The block 10 is cast with its front face 11 down in a form (not shown). The loop 21 facilitates lifting the block 10 from the form after it has cured. Either in addition to or as an alternative to the rod 17, grooves 22 and 23 may be formed in the sides 12 and 13 of the block 10 to facilitate lifting the block 10 while it is horizontal with the tines of a fork lift. The grooves 22 and 23 open to the rear 14 and stop short of the front face 11 so as to not be visible at the exposed face of a retaining wall constructed with the blocks 10.

In order to provide stability to a retaining wall constructed from the blocks 10, at least one, and preferably two knobs 26 project from the block top 15. The knobs 26 are located a predetermined distance from the front face 11 and preferably are symmetrically spaced from the sides 15 and 16. A recess 27 is provided in the block bottom 16. When a plurality of the blocks 10 are stacked to form a retaining wall, each knob 26 on a lower block is received by a recess 27 in an adjacent upper block 10. Preferably, the recess 27 is in the form of a groove which extends completely across the width of the block 10 parallel to the front face 10. The use of two knobs 26 rather than a single rib extending the width of the block 10 facilitates the construction of curved retaining walls.

When a retaining wall constructed from the blocks 10 is to have a substantially vertical face, the recesses 27 and the knobs 26 on the blocks 10 forming the wall will have the same spacing from the front face 11 of each block. If the knobs 26 are spaced further from the front face 11 than the recesses 27, an upper tier of blocks 10 forming a wall will be spaces to the rear of the adjacent lower tier of blocks 10. If desired, the front face 11 may be provided with a slight vertical slope. If the knobs 26 have the same space from an upper edge of the front face 11 as the recesses 27 from a lower edge of the front face 11, the face of the retaining will have the same slope as the front face of the blocks 10.

Figure 3:
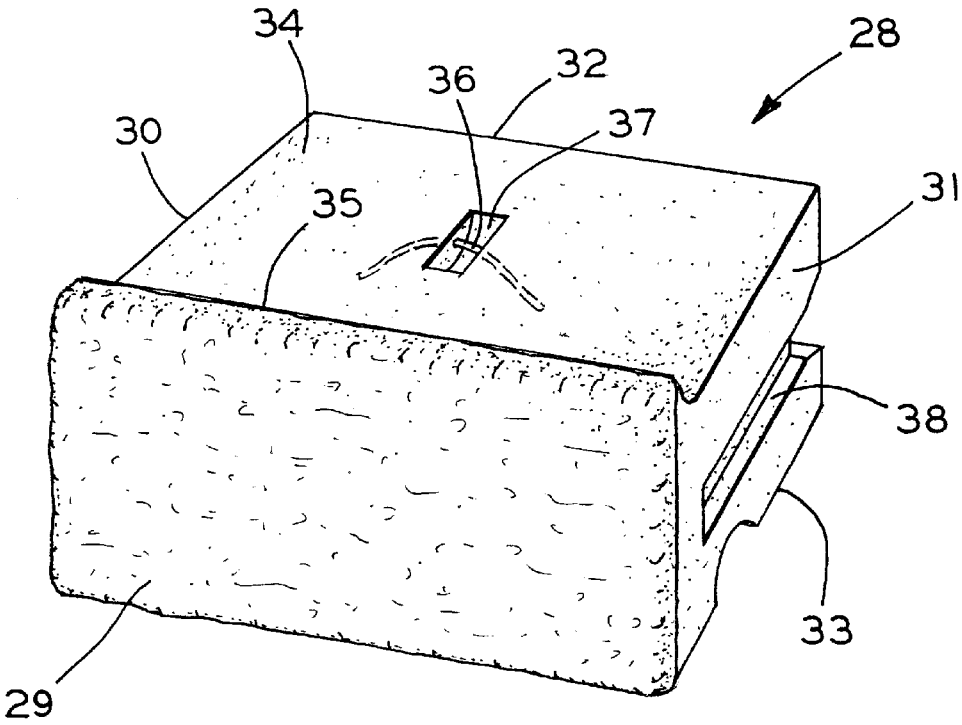
FIG. 3 is a perspective view as seen from the upper right front of a top block for constructing a retaining wall according to one embodiment of the invention.
Figure 4:
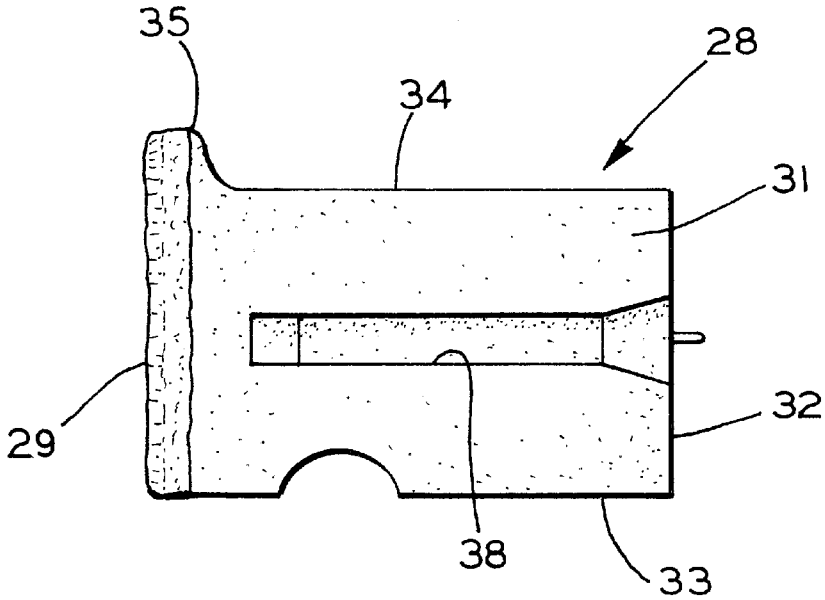
FIG. 4 is a right side elevational view of the top block of FIG. 3.

FIGS. 3 and 4 show details of a top block 28 for forming the top of a retaining wall according to one embodiment of the invention. The top block 28 has a front face 29 which is preferably textured to simulate a desired type of stone or rock, and optionally may be colored. The front face 29, sides 30 and 31, a rear 32 and a bottom 33 of the top block 28 may be the same as for the block 10. The top block 28 differs from the block 10 in that it has a generally flat top surface portion 34 which is recessed below an upper edge 35 of the front face 29. Optionally, a rod 36 may be embedded in the block to extend across a recess 37 in the top surface portion 34 for engagement by a lifting mechanism for lifting the block 29 while it is substantially horizontal. Alternately, the recess 37 may be eliminated and the rod 36 may be bent to form a loop extending above the surface 34 while remaining below the upper edge 35. Also, an optional horizontal grooves 38 may be provided in the sides 30 and 31 to facilitate lifting the horizontal block 29 with the tines of a fork lift. When the top block 28 is located on the top of a retaining wall, the rear side of the retaining wall may be back filled and soil or mulch, for example, may extend over the top surface portion up to the upper edge 35 of the front face 29. Thus, grass or other vegetation may be planted or mulch may be spread over the top of the retaining wall without a risk of it washing over the retaining wall in a heavy rain.

Figure 5:
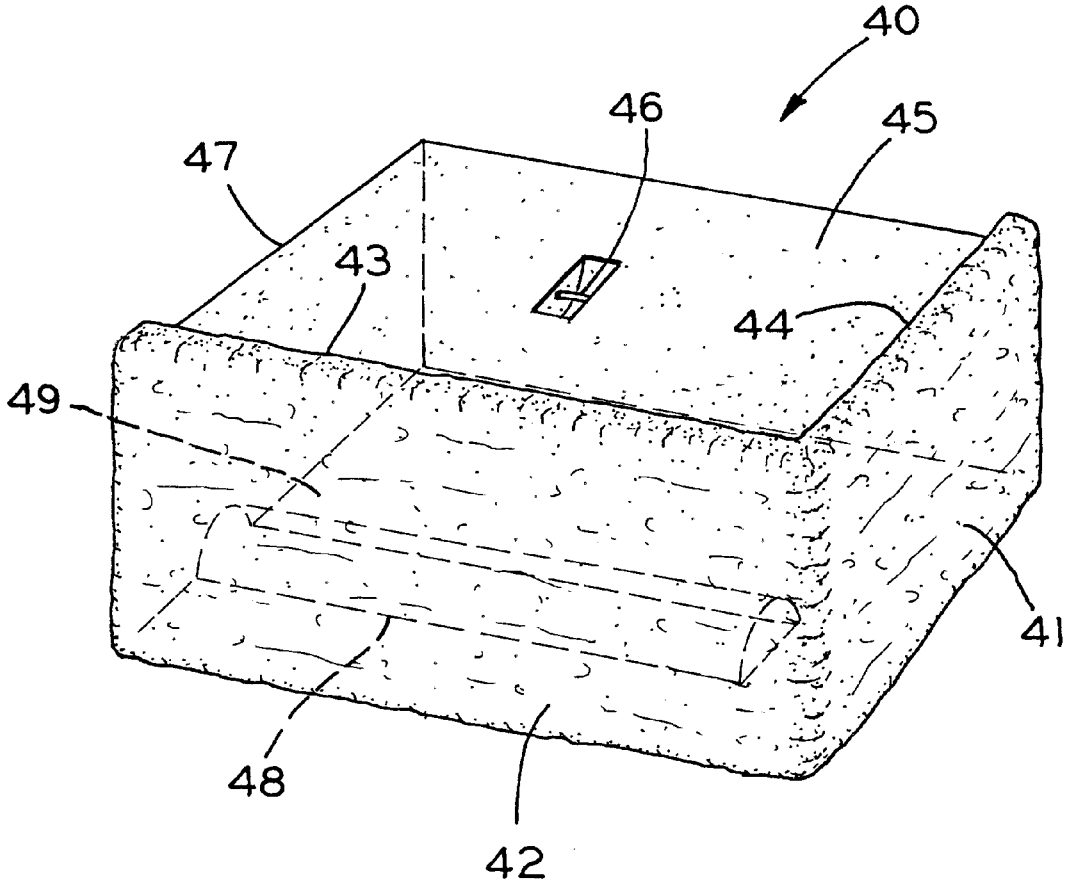
FIG. 5 is a perspective view as seen from the upper right front of an end top block for constructing a retaining wall according to a further embodiment of the invention.

Referring to FIG. 5, an end top block 40 is shown according to a further embodiment of the invention. The end top block 40 is similar to the top block 28, except that a right side 41 of the end top block 40 extends at right angles to a front face 42 of the block 40. Both the front face 42 and the right side 41 are textured and may be colored to simulate a desired rock or stone. The front face 42 has an upper edge 43 which connects with an upper edge 44 of the right side 41. The block 40 has a top surface portion 45 which is recessed below both upper edges 43 and 44. A rod 46 is located in a recess in the top surface portion 45 near the center of gravity of the block 40 to facilitate lifting the block 40 in a generally horizontal attitude. The end top block 40 is designed to be used both at the end of an upper tier of a retaining wall and where the upper tier makes a 90° turn. In a retaining wall in which the tiers step down, the end top block 40 also may be used to create an attractive end for each tier. It will be appreciated that a left side 47 of the block 40 may be finished rather than the right side 41, or that both the left and right sides 47 and 41 may be finished to match the front face 42. The block 40 includes a recess or groove 48 in a bottom 49 for receiving one or more knobs 26 on a lower block. The recess 48 is spaced from and extends parallel to the front face 42. The recess 48 stops short of the finished side 41 and/or 47 so as to not be visible from the front or from the finished sides.

Figure 6:
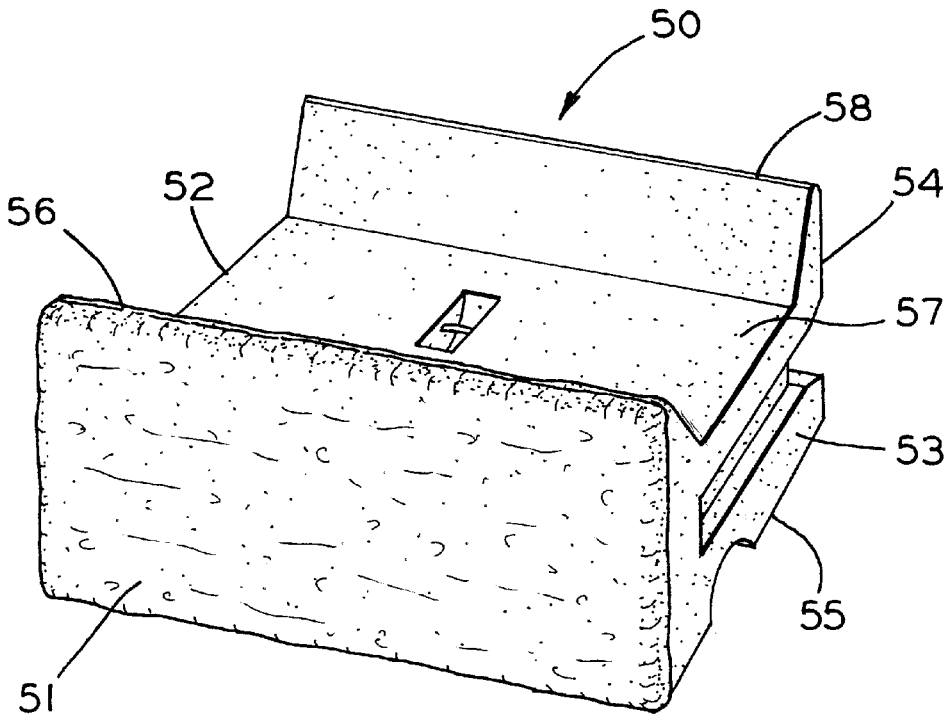
FIG. 6 is a perspective view as seen from the upper right front of a drain ditch top block for constructing a retaining wall according to a further embodiment of the invention.
Figure 7:
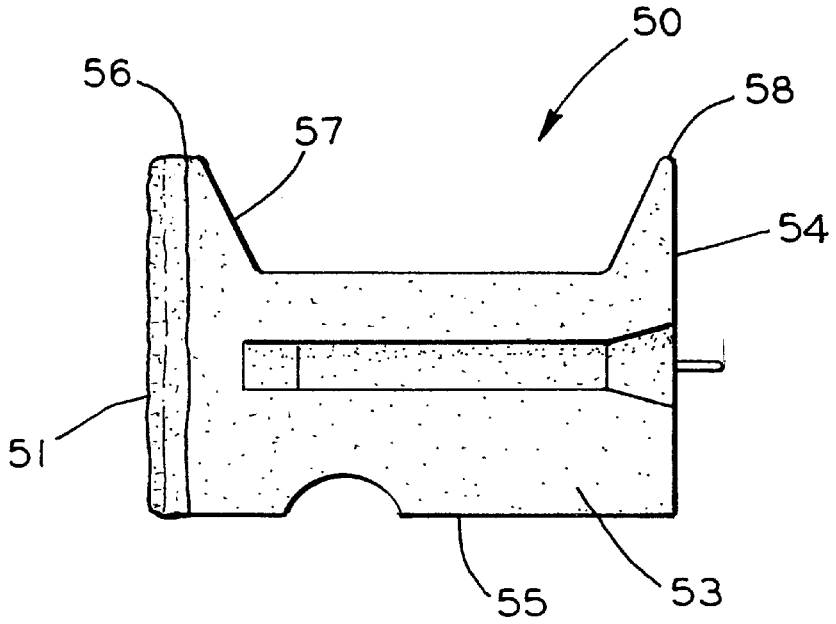
FIG. 7 is a right side elevational view of the top block of FIG. 6.

Some areas which have extreme dry and wet seasons and areas which have poor soil percolation are prone to flooding from sudden heavy rains. When a retaining wall is back filled to its top, heavy rains can cause water to flood over the retaining wall and can cause erosion. FIGS. 6 and 7 show a drain ditch top block 50 which can be placed on the top of a retaining wall. The top block 50 is formed to create a drainage ditch which extends along the top of the retaining wall to control the flow of water over the retaining wall. The top block 50 is similar to the top block 28, in that it has a similar front face 51, left and right sides 52 and 53, rear side 54, and bottom 55. The front face 51 has an upper edge 56. The top block 50 differs from the top block 28 in that it has an upper surface portion 57 which is recessed below both the upper edge 56 of the front face 51 and an upper edge 58 of the rear 54 to form a trough which extends parallel to and between the front face 51 and the rear 54.

When a plurality of top blocks 50 are located in a row along the top of a retaining wall, the recessed top portions 57 form a drainage ditch extending along the top of the retaining wall. It should be appreciated that the drainage ditch may extend along either the entire length of top of the retaining wall or along only a portion of the top of the retaining wall. The drainage ditch may continue to one or both ends of the retaining wall, or it may connect at one or more points along the retaining wall to a storm sewer or to a drain ditch which carries surface water away from the retaining wall.

Figure 8:
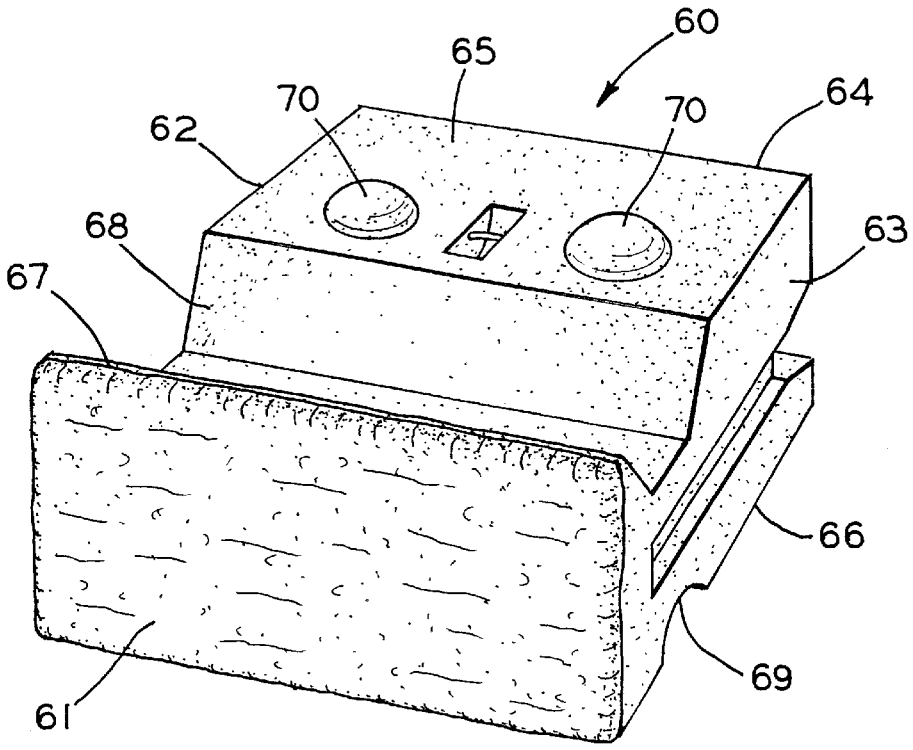
FIG. 8 is a perspective view as seen from the upper right front of a planter block for constructing a retaining wall according to a further embodiment of the invention.
Figure 9:
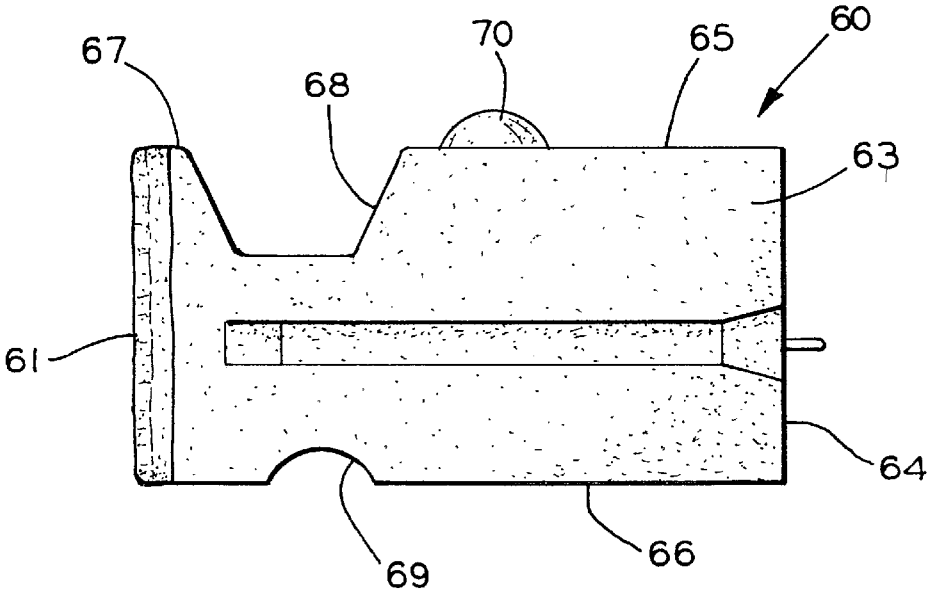
FIG. 9 is a right side elevational view of the planter block of FIG. 8.

Referring to FIGS. 8 and 9, a planter block 60 is shown according to a further embodiment of the invention for use in constructing retaining walls. The planter block 60 has a front face 61 which is preferably textured to imitate the appearance of a desired type of stone or rock, left and right sides 62 and 63, a rear 64, a top 65 and a bottom 66. The front face 61 has an upper edge 67. A trough 68 is formed in the top 65 of the block 60 to extend adjacent to, parallel to and substantially below the upper edge 67. The trough 68 extends between the sides 62 and 63. The bottom 66 of the block 60 has a recess 69, and at least one and preferably two knobs 70 project from the top 65 to the rear of the trough 68. As clearly shown in FIG. 9, the knobs 70 have a greater spacing from the front face 61 than the recess 69.

When a row of the planter blocks 60 is stacked in a retaining wall tier above a tier formed from the blocks 10. the front face 61 of the block 60 will be positioned above and adjacent the front face 11 of the block 10. When a row of the blocks 10 are stacked above a retaining wall tier formed from the planter blocks 60, the front faces 11 of the blocks 10 will be stepped behind the front faces 61 of the blocks 60 sufficiently to expose at least a portion of the trough 68. The trough 68 is then filled with soil for planting, for example, flowers, small bushes or vines which will grow over the retaining wall. The step back in the face of the retaining wall at a tier formed from the planter blocks 60 also provides increased stability to the retaining wall, permitting construction of the retaining wall to a greater height.

For stability, retaining walls are constructed with the blocks staggered in adjacent tiers, in a manner similar to constructing a brick wall. Thus the seam between two abutting blocks in a wall is located below and above the center of blocks in adjacent upper and lower tiers, respectively. Although not illustrated, it will be appreciated that half width blocks may be provided for each of the blocks 10, 28, 40, 50 and 60 to finish the end of a retaining wall.

Figure 10:
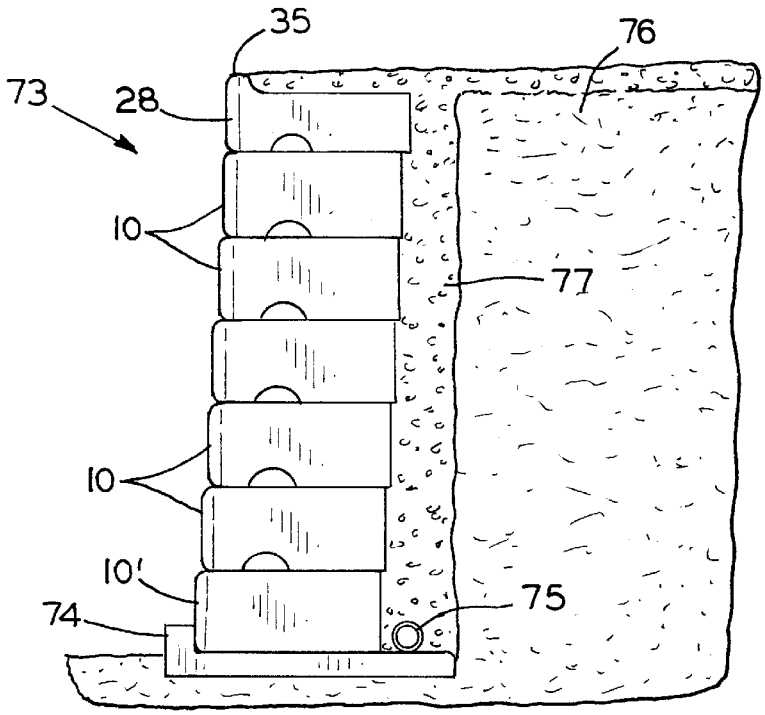
FIG. 10 is a cross sectional view through one embodiment of a seven tier retaining wall constructed with blocks according to the invention.

FIG. 10 is a cross section through an exemplary retaining wall 73 constructed with tiers of the basic blocks 10 and topped with a tier of top blocks 28. Optionally, the wall 73 may be supported on a poured concrete footer 74. Alternately, the wall 73 may be constructed on a footing of a suitable packed and leveled granular bearing material. Base blocks 10' may be used in the lowermost tier which are identical to the blocks 10, except that they do not have a bottom recess 27. It will be apparent that the recess 27 is not needed in the lowermost tier of blocks. Also, for higher retaining walls the omission of the recess 27 gives a greater flat bearing surface for supporting the retaining wall. Preferably, a geotextile wrapped perforated drain 75 is installed behind the base of the blocks 10' in the lowermost tier. After the lowermost tier of the blocks 10' is installed, tiers of the blocks 10 set in place, with the seams between the blocks in each tier staggered from the seams in the adjacent tiers. As the tiers of blocks 10 are installed, the area between the blocks 10', 10 and the existing soil 76 is filled with a free draining aggregate 77 and the aggregate 77 is tamped. Finally, the uppermost tier of the wall 73 is formed with a row of top blocks 28 and, optionally, top soil 78 is spread over the surface up to the upper edge 35 of the front face of the top blocks 28 to complete the retaining wall 73. In some installations, mulch, gravel or paving may extend over the top blocks 28 up to the upper edge 35.

Figure 11:
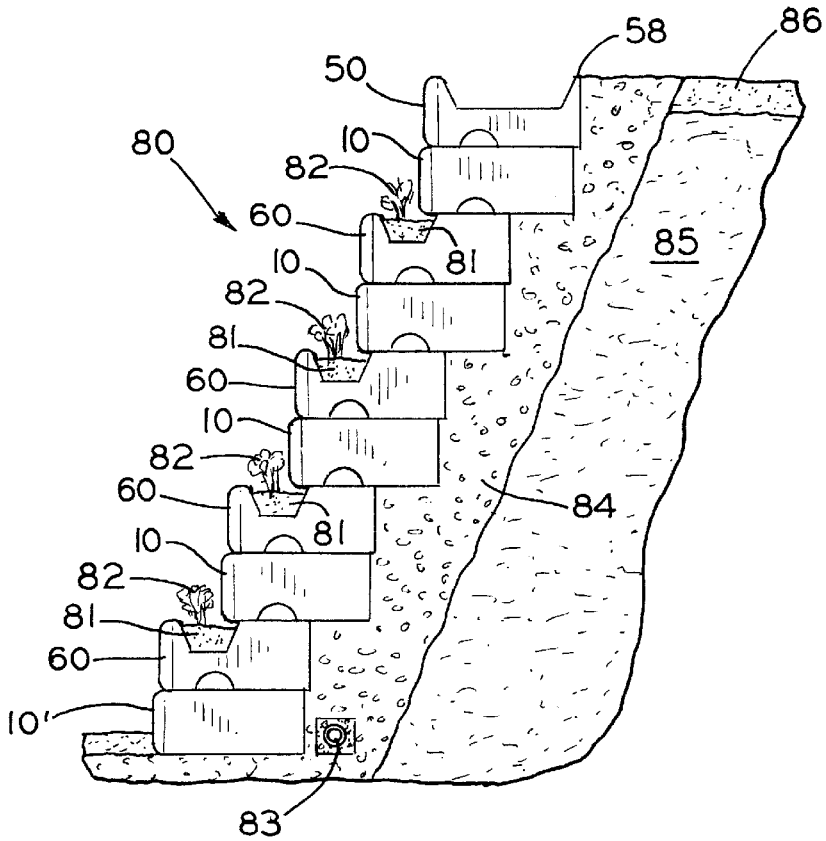
FIG. 11 is a cross sectional view through a further embodiment of a ten tier retaining wall constructed with blocks according to the invention, with four tiers of planter blocks and topped with a drain ditch block.

FIG. 11 illustrates an exemplary retaining ten tier retaining wall 80. The illustrated retaining wall 80 constructed from a lower tier of blocks 10', alternating tiers of planter blocks 10 and basic blocks 10, and topped with a drain ditch top block 50. Because of the planter blocks 60, the retaining wall 80 will have a general slope rather than the substantially vertical retaining wall 73 of FIG. 10. The illustrated retaining wall 80 has four tiers formed from planter blocks 60. The troughs in the planter blocks 60 are filled with top soil 81 and plants 82, such as flowers, vines or small bushes. A geotextile fabric wrapped perforated drain 83 is positioned behind the base of the lowermost tier of blocks 10' and is surrounded by stone. An area between the retaining wall 80 and the existing soil 85 is filled with a compacted, free draining aggregate 84. Topsoil 86 or other desired surface material may be placed above the existing soil 85 to extend up to the upper rear edge 58 of the top block 50. It should be appreciated that a retaining wall may be constructed with one or more tiers of planter blocks 60 separated by one or more tiers of blocks 10 to provide a desired appearance and slope.

Figure 12:
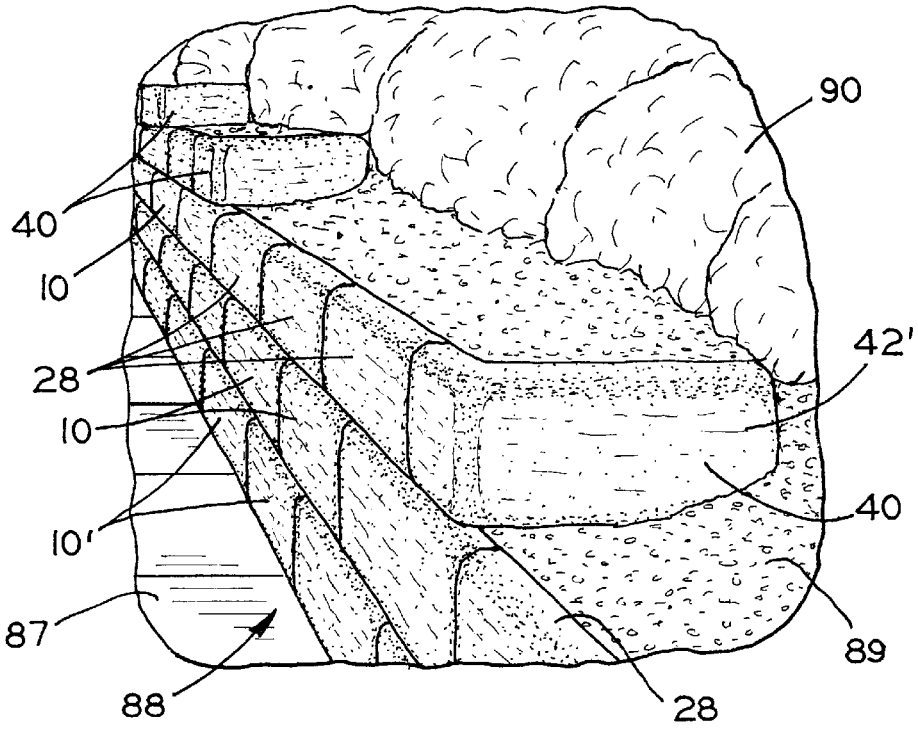
FIG. 12 is a fragmentary perspective view of a stepped retaining wall according to a further embodiment of the invention.

FIG. 12 is a fragmentary illustration of a stepped retaining wall 88 arrangement formed from base blocks 10', blocks 10, top blocks 28, and end blocks 40'. The end blocks 40' are identical to the end blocks 40, except that both left and right sides of the end blocks 40' are finished and of the same height as the front face. The retaining wall 88 has a lowermost tier of base blocks 10'. In the portion of the retaining wall 88 nearest the lower center of FIG. 12, the retaining wall is only two tiers high, with the upper tier formed from a top block 28. Where the wall is three or more tiers high, blocks 10 form the intermediate tiers, and top blocks 28 form the upper tier. An end block 40 is used at the end of each tier. In the illustrated wall 88, the end blocks 40 are rotated 90° so that the longer front face 42' extends perpendicular to the front face of the wall 88. The area immediately adjacent the top blocks 28 and the end blocks 40' is shown covered with mulch 89, and bushes 90 are planted behind the mulch 89. In the illustrated wall 88, a sidewalk 87 is poured up to the lowermost tier of blocks 10'.

As indicated above in the description of the basic wall blocks 10, the blocks 10 are generally trapezoidal in plan.

Figure 13:
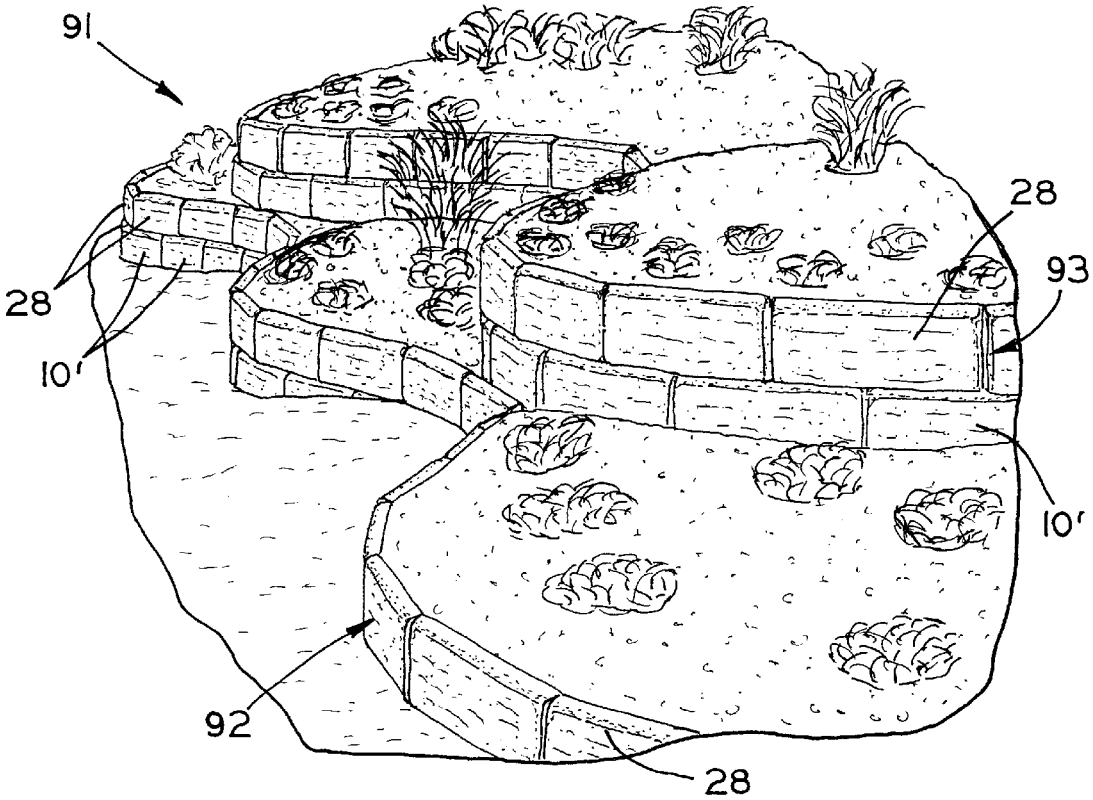
FIG. 13 is a fragmentary perspective view of a landscape area including two serpentine retaining walls according to the invention.

This allows forming curved retaining walls with the front faces of adjacent blocks 10 abutting. FIG. 13 illustrates an exemplary landscape area 91 formed from a serpentine lower retaining wall 92 and a serpentine upper retaining wall 93. The serpentine lower retaining wall 92 is formed from a tier of top blocks 28 and, where the wall 92 has two tiers, a lower tier formed from blocks 10'. The number of tiers in the lower wall 92 is selected to provide a horizontal upper edge to the lower wall 92. If necessary, a portion of the lowermost tier of blocks may be partially buried. A portion of the illustrated lower wall 92 is one tier high and a portion is two tiers high to compensate for elevational changes in the surrounding terrain. The illustrated upper wall 93 is two tiers high. For aesthetics, the upper wall 93 has a different serpentine arrangement from the lower wall. Areas between the walls 92 and 93 and the area above the upper wall 93 are landscaped with mulch and bushes.

Figure 14:
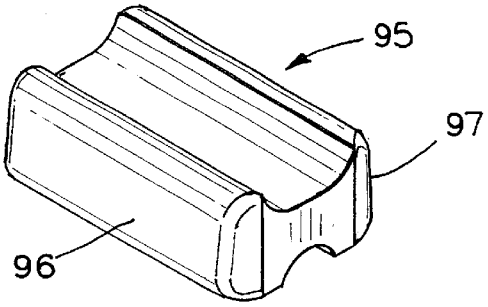
FIG. 14 is a perspective view of a top block for a free standing wall according to the invention.
Figure 15:
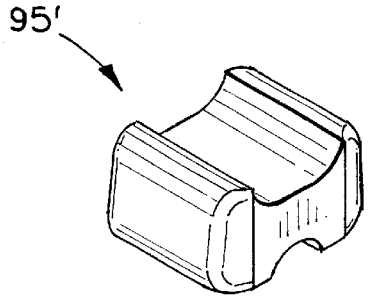
FIG. 15 is a perspective view of a half top block for a free standing wall.
Figure 16:
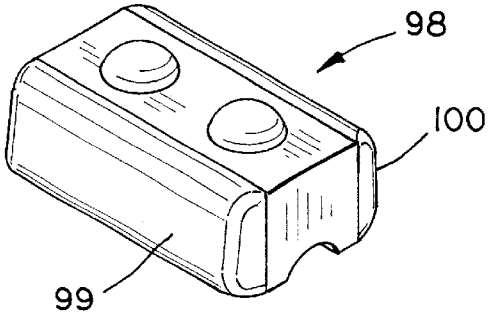
FIG. 16 is a perspective view of an intermediate tier block for a free standing wall according to the invention.
Figure 17:
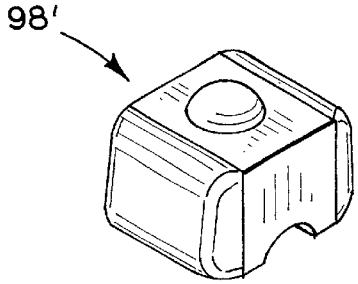
FIG. 17 is a perspective view of a half intermediate tier block for a free standing wall.
Figure 18:
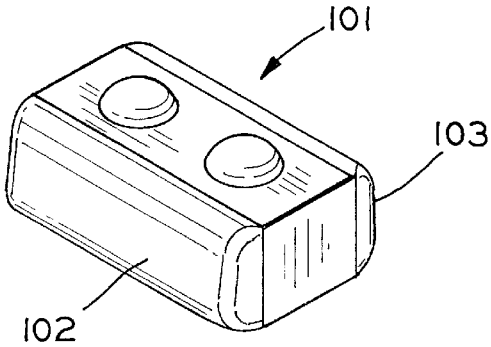
FIG. 18 is a perspective view of a lowermost tier or base block for the base of a free standing wall.
Figure 19:
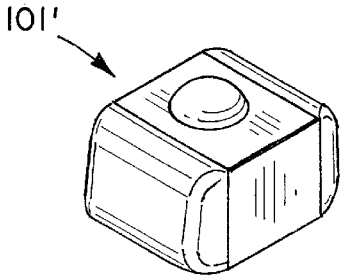
FIG. 19 is a perspective view of a half base block for a free standing wall.
Figure 20:
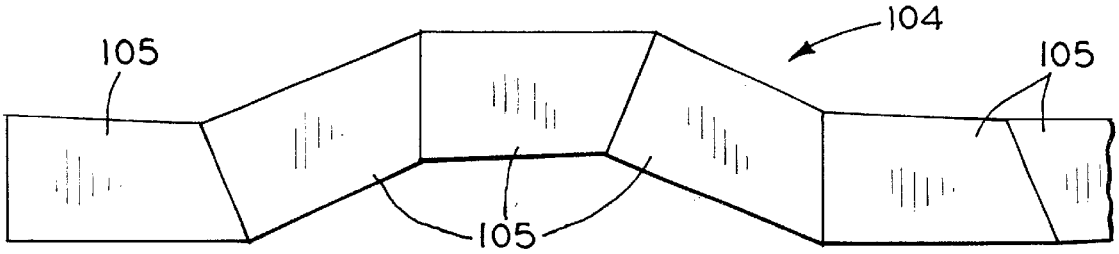
FIG. 20 is a top plan view of a free standing retaining wall wherein the blocks are illustrated as having the shape of a right trapezoid in plan.

It should be appreciated that the above described retaining wall blocks may be modified for constructing a free standing wall which is finished on both sides. FIG. 14 shows a top block 95 having a finished front face 96 and a finished rear face 97, and FIG. 15 shows a half width top block 95'. The top of the top blocks 95, 95' may be recessed, as shown, to permit growing landscape plants on top of the wall, or it may be flat (not shown). FIG. 16 shows a basic or intermediate tier block 98 having a finished front face 99 and a finished rear face 100, and FIG. 17 shows a half width intermediate tier block 98'. FIG. 18 shows a bottom tier block 101 having a finished front face 102 and a finished rear face 103, and FIG. 19 shows a half width bottom tier block 101'. The blocks 95, 98 and 101 may be formed to be rectangular in plan if a straight wall is to be constructed, or trapezoidal in cross section if curved walls are to be constructed. Curved and straight walls are created by selecting the orientation of the blocks. If alternate blocks are reversed so that the shorter finished face of adjacent blocks are on opposite sides of the wall, the wall will be straight. If the shorter finished faces of two adjacent blocks abut, the wall will curve. The blocks 95, 98 and 103 also may be formed to have a shape in plan of a right trapezoid, wherein one end is perpendicular to the sides, as shown in the top plan view of a section of a free standing wall 104 in FIG. 20 formed from blocks 105.

It will be appreciated that various modifications and changes may be made to the above described preferred embodiments of retaining wall blocks and retaining walls constructed from such blocks without departing from the scope of the following claims.

What is claimed is:

1. A planter block for use in a retaining wall formed from tiers of blocks, at least some of the blocks in the wall having a bottom recess spaced a predetermined distance to the rear of a front face on such blocks, said planter block having a textured front face having an upper edge, two sides, a rear, a top and a bottom, a trough recessed in said top to extend substantially parallel to said front face and to extend to the rear of and below said upper edge, said trough having a size and shape sufficiently receiving soil and plants, and at least one projection means on said top spaced to the rear of said trough and a distance from said front face of said planter block greater than the predetermined distance for engaging a bottom recess in a block which is placed in an adjacent upper tier when said planter block is installed in a retaining wall, whereby at least a portion of said trough will extend forward from the front face of a block placed on said planter block in an adjacent upper tier of such wall with a bottom groove in such block receiving said at least one projection means.

2. A planter block for use in a retaining wall, as set forth in claim 1, and further including a member embedded in said planter block and having a portion forming a hook for lifting said top block from said top.

3. A planter block for use in a retaining wall, as set forth in claim 2, and wherein said member is embedded in said planter block with said portion located in said trough.

4. A planter block for use in a retaining wall, as set forth in claim 2, and wherein said member is embedded in said planter block with said portion located in a recess in said trough.

5. A planter block for use in a retaining wall formed from at least two tiers of blocks, at least some of the blocks in the wall having a bottom recess spaced a predetermined distance to the rear of a front face on such blocks, said planter block having a textured front face having an upper edge, two sides, a rear, a top and a bottom, a trough formed in said top to extend substantially parallel to said front face adjacent and below said upper edge, said trough having a size and shape sufficiently soil and plants after said planter block is positioned in a retaining wall, and at least one top projection means on said planter block spaced to the rear of said trough a distance greater than the predetermined distance for engaging a bottom recess in at least one block placed in an adjacent upper tier of a wall, whereby when said at least one top projections is received by a recess in at least one block in an adjacent upper tier of blocks the front face of such at least one block will be positioned sufficiently behind said front face of said planter block whereby said trough is open in front of the front face of the at least one block for receiving and growing plants in soil placed in said trough.

6. A planter block for use in a retaining wall, as set forth in claim 5, and wherein said planter block has a generally trapezoidal shape in plan with said front face and rear substantially parallel and said rear shorter in width than said front face.

7. A planter block for use in a lower tier of two tiers of blocks in a retaining wall with blocks in an upper tier having a face, a bottom, and at least one recess in the bottom a predetermined distance behind the face, said planter block having a front face having an upper edge, a top, a bottom, left and right sides and a rear, at least one projection extending above said top at a first distance behind said front face greater than the predetermined distance, said at least one projection having a size smaller than the at least one recess whereby said at least one projection can be received by a recess in an upper tier block when such block is placed on said planter block, a trough formed in said top between said at least one projection and said front face to extend generally parallel to said front face, said trough having a size and shape sufficiently receiving soil and plants, and wherein at least a portion of said trough is spaced towards said front face from said at least one projection by a distance greater than the predetermined distance.

8. A planter block for use in a retaining wall, as set forth in claim 7, and further including a member embedded in said planter block and having a portion extending into said trough to form a hook for lifting said top block from said top.

9. A planter block for use in a retaining wall, as set forth in claim 7, and wherein said planter block has a generally trapezoidal shape in plan with said front face and rear substantially parallel and said rear shorter in width than said front face.

* * * * *